US011415076B2

(12) United States Patent
Henzold et al.

(10) Patent No.: US 11,415,076 B2
(45) Date of Patent: Aug. 16, 2022

(54) METHOD FOR PRODUCING A PISTON FOR AN INTERNAL COMBUSTION ENGINE, PISTON FOR AN INTERNAL COMBUSTION ENGINE, PISTON BLANK FOR PRODUCING THE PISTON, AND CASTING MOLD OR FORGING DIE FOR PRODUCING A PISTON BLANK

(71) Applicant: FEDERAL-MOGUL NURNBERG GMBH, Nuremberg (DE)

(72) Inventors: Ulrich Henzold, Nuremberg (DE); Harald Mergler, Nuremberg (DE); Christoffer Schmoll, Nuremberg (DE)

(73) Assignee: Federal-Mogul Nurnberg GmbH, Nuremberg (DE)

( * ) Notice: Subject to any disclaimer, the term of this patent is extended or adjusted under 35 U.S.C. 154(b) by 0 days.

(21) Appl. No.: 16/628,433

(22) PCT Filed: Jul. 2, 2018

(86) PCT No.: PCT/EP2018/067789
§ 371 (c)(1),
(2) Date: Jan. 3, 2020

(87) PCT Pub. No.: WO2019/007897
PCT Pub. Date: Jan. 10, 2019

(65) Prior Publication Data

US 2020/0158046 A1 May 21, 2020

(30) Foreign Application Priority Data

Jul. 4, 2017 (DE) ..... 11 2017 211 335.9

(51) Int. Cl.
*F02F 3/00* (2006.01)
*F02F 3/22* (2006.01)
(Continued)

(52) U.S. Cl.
CPC ..... *F02F 3/22* (2013.01); *F02F 3/02* (2013.01); *F02F 3/18* (2013.01); *F02F 3/0084* (2013.01); *F02F 2003/0007* (2013.01)

(58) Field of Classification Search
CPC ... F02F 3/22; F02F 3/003; B23P 15/10; F05C 2201/0448
(Continued)

(56) References Cited

U.S. PATENT DOCUMENTS 8,739,755 B2 * 6/2014 Stan ..... F02F 3/003 123/193.6
8,899,208 B2 * 12/2014 Bischofberger ..... F02F 3/18 123/41.35
(Continued)

FOREIGN PATENT DOCUMENTS

CN 101031742 A 9/2007
CN 201486677 U 5/2010
(Continued)

OTHER PUBLICATIONS

Dieter Gabriel et al: "Lightweight Pistons for Friction Optimized Ignition Engines", ASME 2014 Internal Combustion Engine Division Fall Technical Conference vol. 2: Instrumentation, Controls, and Hybrids; Numerical Simulation; Engine Design and Mechanical Development; Keynote Papers, Columbus, Indiana, USA, Oct. 19-22, 2014 CONFE, vol. 2, No. ICEF2014-5452, V002T07A007, Oct. 19, 2014 (Oct. 19, 2014), XP009506982, DOI:10.1115/ICEF2014-5452, ISBN 978-0-7918-4617-9.
(Continued)

*Primary Examiner* — Long T Tran
*Assistant Examiner* — James J Kim
(74) *Attorney, Agent, or Firm* — Robert L. Stearns; Dickinson Wright, PLLC

(57) ABSTRACT

A method for producing a piston blank or a piston for an internal combustion engine, includes providing a thickened
(Continued)

portion formed in at least one box wall in the direction of thickness approximately in the center thereof, which is at least partly flush with a cooling channel. A resulting piston blank or piston having these features can be made in a casting mold or forging die designed in a corresponding manner.

9 Claims, 1 Drawing Sheet

(51) Int. Cl.
*F02F 3/02* (2006.01)
*F02F 3/18* (2006.01)

(58) Field of Classification Search
USPC ..... 123/193.6
See application file for complete search history.

(56) References Cited

U.S. PATENT DOCUMENTS

2013/0276740 A1* 10/2013 Wandrie, III ..... B23K 20/129 123/193.6
2013/0312695 A1 11/2013 Bischofberger
2013/0333657 A1 12/2013 Noedl
2014/0083390 A1* 3/2014 Azevedo ..... F02F 3/0069 123/193.6
2015/0075455 A1 3/2015 Bischofberger
2016/0025034 A1 1/2016 Lormes
2016/0123274 A1* 5/2016 Miller ..... F02F 3/20 123/41.35
2016/0222911 A1* 8/2016 Salenbien ..... F02F 3/18
2017/0268456 A1* 9/2017 Funahashi ..... B22C 9/062
2018/0266557 A1 9/2018 Braig et al.
2020/0173393 A1* 6/2020 Urzua Torres ..... F16J 1/04
2020/0208591 A1* 7/2020 Higasa ..... F02F 3/02

FOREIGN PATENT DOCUMENTS

CN 103443432 A 12/2013
CN 103890364 A 6/2014
CN 204163871 U 2/2015
CN 205297761 U 6/2016
DE 4338571 A1 5/1994
DE 102011114105 A1 6/2012
DE 102011113800 A1 3/2013
DE 102013218764 A1 9/2014
DE 102014222416 A1 5/2016
DE 102015217911 A1 3/2017
JP 58190538 A 11/1983

OTHER PUBLICATIONS

International Search Report, dated Aug. 8, 2018 (PCT/EP2018/067789).

* cited by examiner

METHOD FOR PRODUCING A PISTON FOR AN INTERNAL COMBUSTION ENGINE, PISTON FOR AN INTERNAL COMBUSTION ENGINE, PISTON BLANK FOR PRODUCING THE PISTON, AND CASTING MOLD OR FORGING DIE FOR PRODUCING A PISTON BLANK

BACKGROUND

1. Technical Field

The invention relates to a method for producing a piston for an internal combustion engine, a piston for an internal combustion engine, a piston blank for producing the piston, and a casting mold or forging die for producing a piston blank.

In the field of pistons for internal combustion engines, it is customary for the purposes of cooling the piston to form a largely ring-shaped cooling channel which is supplied with cooling oil by means of at least one inlet proceeding largely parallel to the piston axis, said cooling oil leaving the cooling channel at at least one outlet which likewise proceeds substantially parallel to the piston axis.

2. Related Art

JP 58190538 A relates to a forged piston in which the coolant inlets and outlets are formed directly in the area of the piston pin bosses. The same applies for the piston according to CN 205297761 U.

Finally, DE 10 2014 222 416 A1 reveals an aluminium piston in which the coolant inlets and outlets are formed on the outside on the so-called box walls, which extend between the (load-bearing) shaft walls and receive the piston bin bosses.

SUMMARY OF THE INVENTION

Against this background, the object of the invention is firstly to create a method for producing a piston with the aid of which a piston which is improved with respect to the so-called retention rate, in other words the proportion of the cooling oil actually reaching the cooling channel, can be produced in an efficient manner. Furthermore, a corresponding piston, piston blank and casting mold or forging die are to be created for it.

Accordingly, already as part of the production of a piston blank, a thickened portion is formed in at least one box wall in the direction of thickness approximately in the center thereof, which is at least partly flush with a cooling channel. The thickened portion described can be used to form the coolant inlets and outlets in that an opening leading to the cooling channel, in particular a bore, is created. Thus, only a few production steps are required, and no additional components, so that simple and cost-efficient production is enabled. At the same time, it can be ensured that a sufficient quantity of cooling oil reaches the cooling channel during operation.

Furthermore, since the thickened portion is formed in a box wall and not directly adjacent to a piston pin boss, an undesirable mass of material is thereby avoided. Moreover, a sufficiently great distance from moving parts such as a connecting rod can be kept in an advantageous manner.

Measures preferred for this purpose and preferred further developments are described in the further claims.

At least in certain applications there are advantages if at least one box wall is formed on the outside on a piston pin boss since sufficient space for the bores is thereby created in an advantageous manner, and at the same time the necessary distance from the connecting rod as a moving part is kept.

Although as part of the method according to the invention the production of a light metal, in particular aluminium, piston and/or through casting is also possible, the current preference is, according to the invention, to make the piston blank by forging and/or from iron or steel. Steel or iron casting, in particular ductile iron, is preferred as the casting method.

The retention rate can be further increased in an advantageous manner by reworking at least one thickened portion mechanically such that at least one coolant inlet or outlet bore is formed at least partially in a funnel shape.

In certain applications it has further proved to be advantageous if two thickened portions are formed in each of both box walls, so that a total of four inlet or outlet bores are present.

It also offers advantages in certain situations if the cooling channel is filled with a coolant such as sodium, and is subsequently sealed.

In accordance with the method described above, the piston according to the invention is provided with at least one thickened portion which advantageously is not mechanically reworked, with the exception of a bore possibly formed therein. The piston blank according to the invention that is used for this purpose and the casting mold or forging die according to the invention correspond to the fore-mentioned features of the method according to the invention. This equally applies to the preferred embodiments, and it should be mentioned that all features mentioned in connection with the method, the piston, the piston blank, the casting mold and/or the forging die can equally be applied to the respective other subject matters of this application and vice versa.

BRIEF DESCRIPTION OF THE DRAWINGS

A preferred embodiment example of the invention is described in more detail below with reference to the figures.

DETAILED DESCRIPTION

Figure 1:
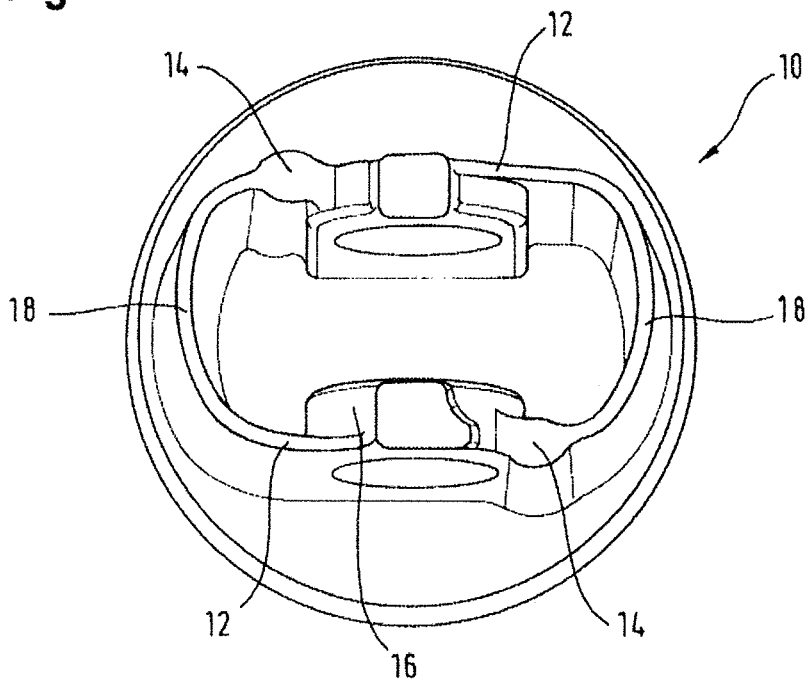
FIG. 1 shows a bottom view of a piston blank according to the invention.

As FIG. 1 shows, a piston blank 10 according to an embodiment of the invention has two load-bearing shaft wall portions 18 and two box walls 12 which receive the piston pin bosses 16. As can further be seen in the figure, a thickened portion 14 is formed at two diametrically opposed points in the box wall, which lies approximately in the center of the box wall to the extent that the box wall would, in an imagined continued path, proceed approximately centrally through the thickened portion 14. In other words, the box wall is "bulged" in both directions, to the inside and to the outside, in order to form the thickened portion described. In other words, the respective thickened portion is preferably formed substantially symmetrically with respect to the box wall 12 as an axis of symmetry.

Figure 2:
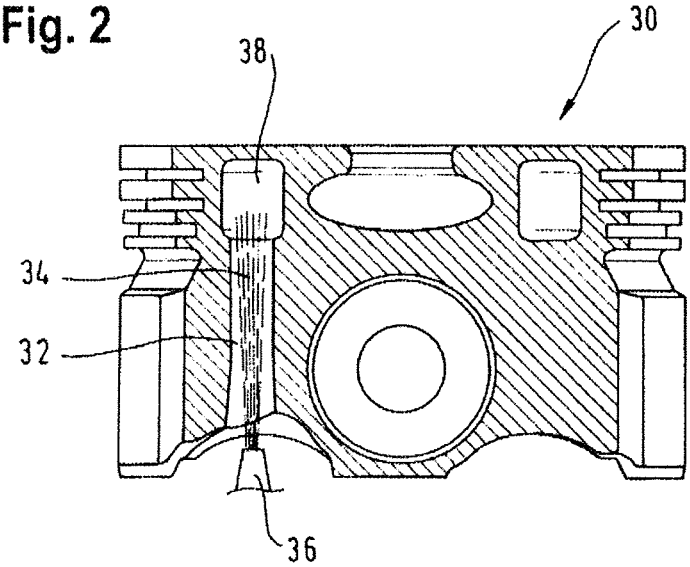
FIG. 2 shows a sectional view through a piston according to the invention.

As can be seen in FIG. 2, a bore 32 can be created in a direction approximately parallel to the piston axis (in FIG. 1 perpendicular to the reference plane, in FIG. 2 from top to bottom), said bore, as shown in FIG. 2, enabling the supply of cooling oil 34 from a cooling nozzle 36 into a cooling channel 38. In order to increase the retention rate in this connection, the bore 32 is widened in a funnel shape at its end opposite the cooling channel 38.

FIG. 1 also reveals that in the case shown the box walls 12 are formed on the outside on the piston pin bosses 16. However, the piston pin bosses 16 can protrude or spring back relative to the box walls 12.

The invention claimed is:

1. A method for producing a piston for an internal combustion engine, in which, as part of the production of a piston blank by forging, a thickened portion is formed by forging in at least one box wall in the direction of thickness in the center thereof, which is at least partly flush with a cooling channel; said at least one box wall is formed on the outside of a piston pin boss, the pin boss having a planar outer face, and said at least one box wall bulges outward beyond said planar face to form said thickened portion.

2. The method according to claim 1, wherein the piston blank is made from iron or steel.

3. The method according to claim 1, wherein the thickened portion is mechanically reworked such that at least one coolant inlet or outlet bore is formed at least partially in a funnel shape.

4. The method according to claim 1, wherein the cooling channel is filled with a fluid.

5. A piston for an internal combustion engine having at least one box wall in which a thickened portion is formed by forging in the direction of thickness in the center, which is not mechanically reworked with the exception of a bore formed therein, with at least one box wall being formed on the outside of a pin boss, the pin boss having a planar outer face, and said at least one box wall bulging outward beyond said planar face to form said thickened portion.

6. The piston according to claim 5, wherein a said bore is formed in at least one thickened portion, which is formed at least partially in a funnel shape.

7. A piston for an internal combustion engine, comprising:

a piston body having a pair of pin bosses each having a planar outer face and each received between two box walls extending laterally of the pin bosses to opposite sides thereof;

an annular cooling channel disposed above the pin bosses;

at least one of said box walls having a locally thickened region extending in a longitudinal direction of the piston;

said at least one of said box walls bulging inward of the box wall and bulging outward of the planar face of the associated pin to form said locally thickened region; and wherein said locally thickened section is provided between one of the pin bosses and a load-bearing shaft wall of said piston body, said locally thickened section includes a bore open at a bottom of the at least one thickened portion and communicating at an open end of the bore with said cooling channel.

8. The piston of claim 7, wherein a lower end of the bore is flared.

9. The piston of claim 7, wherein the bore enables the supply of cooling oil from a cooling nozzle into the cooling channel.

* * * * *